US007641412B2

(12) United States Patent
Hirano

(10) Patent No.: US 7,641,412 B2
(45) Date of Patent: Jan. 5, 2010

(54) BALL-POINT PEN

(75) Inventor: Koichi Hirano, Yokohama (JP)

(73) Assignee: Mitsubishi Pencil Co., Ltd., Tokyo (JP)

( * ) Notice: Subject to any disclaimer, the term of this patent is extended or adjusted under 35 U.S.C. 154(b) by 463 days.

(21) Appl. No.: 10/589,973

(22) PCT Filed: Feb. 16, 2005

(86) PCT No.: PCT/JP2005/002325

§ 371 (c)(1),
(2), (4) Date: Aug. 18, 2006

(87) PCT Pub. No.: WO2005/080094

PCT Pub. Date: Sep. 1, 2005

(65) Prior Publication Data

US 2007/0183837 A1 Aug. 9, 2007

(30) Foreign Application Priority Data

Feb. 24, 2004 (JP) ..... 2004-048046

(51) Int. Cl.
*B43K 7/10* (2006.01)

(52) U.S. Cl. ..... 401/216; 401/209; 401/208

(58) Field of Classification Search ..... 401/212–214, 401/216, 208, 209; 29/441.1, 441.2
See application file for complete search history.

(56) References Cited

U.S. PATENT DOCUMENTS 4,139,313 A * 2/1979 Hori ..... 401/216
4,311,403 A * 1/1982 Liguori ..... 401/209
6,076,987 A * 6/2000 Sekine et al. ..... 401/209
6,341,914 B2 * 1/2002 Abe et al. ..... 401/216
6,602,011 B2 * 8/2003 Tanaka ..... 401/214

FOREIGN PATENT DOCUMENTS

| | | | |
|---|---|---|---|
| JP | 7-37681 | U | 7/1995 |
| JP | 8-118876 | A | 5/1996 |
| JP | 8-118877 | A | 5/1996 |
| JP | 2004-314317 | A | 11/2004 |

OTHER PUBLICATIONS

International Search Report mailed Apr. 19, 2005 of International Application PCT/JP2005/002325.

* cited by examiner

*Primary Examiner*—David J. Walczak
*Assistant Examiner*—Keegan Gumbs
(74) *Attorney, Agent, or Firm*—Westerman, Hattori, Daniels & Adrian, LLP

(57) ABSTRACT

A ball-point pen, wherein a cover member (6) is fitted to a joint member (3) connecting a writing tip (1) rotatably supporting a writing ball (2) at the tip thereof to an ink storage tube. When the cover member (6) is fitted to the joint member (3) along the outer peripheral surface thereof, a part of the cover member does not come within 0.2 mm (within the range of the chain double-dashed line) from around the writing tip. Thus, even if the accuracies of parts and assembly machines are dispersed, a problem with an existing ball-point pen wherein a cover member is brought into contact with a writing tip and the writing tip is damaged in an assembly step can be avoided.

6 Claims, 13 Drawing Sheets

[Fig. 1]
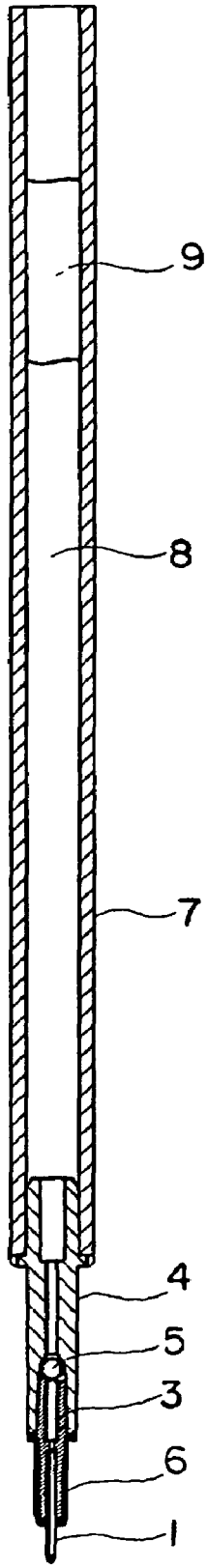

[Fig. 2]
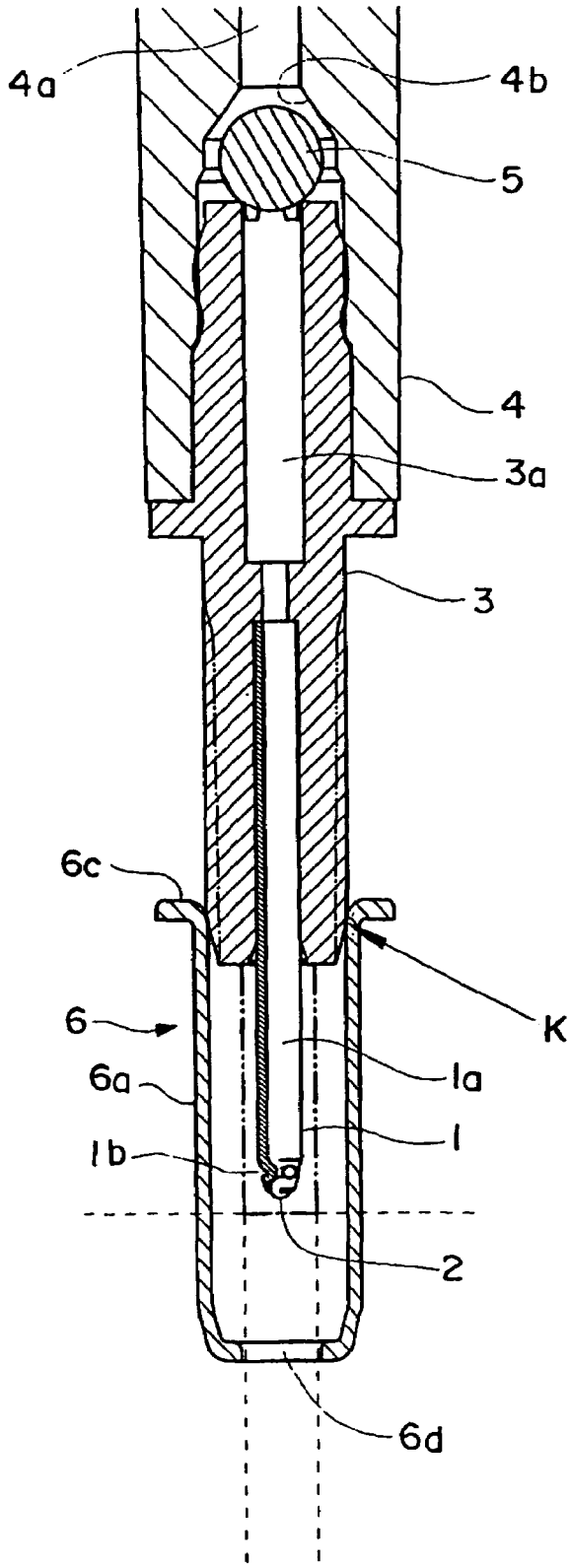

[Fig. 3]
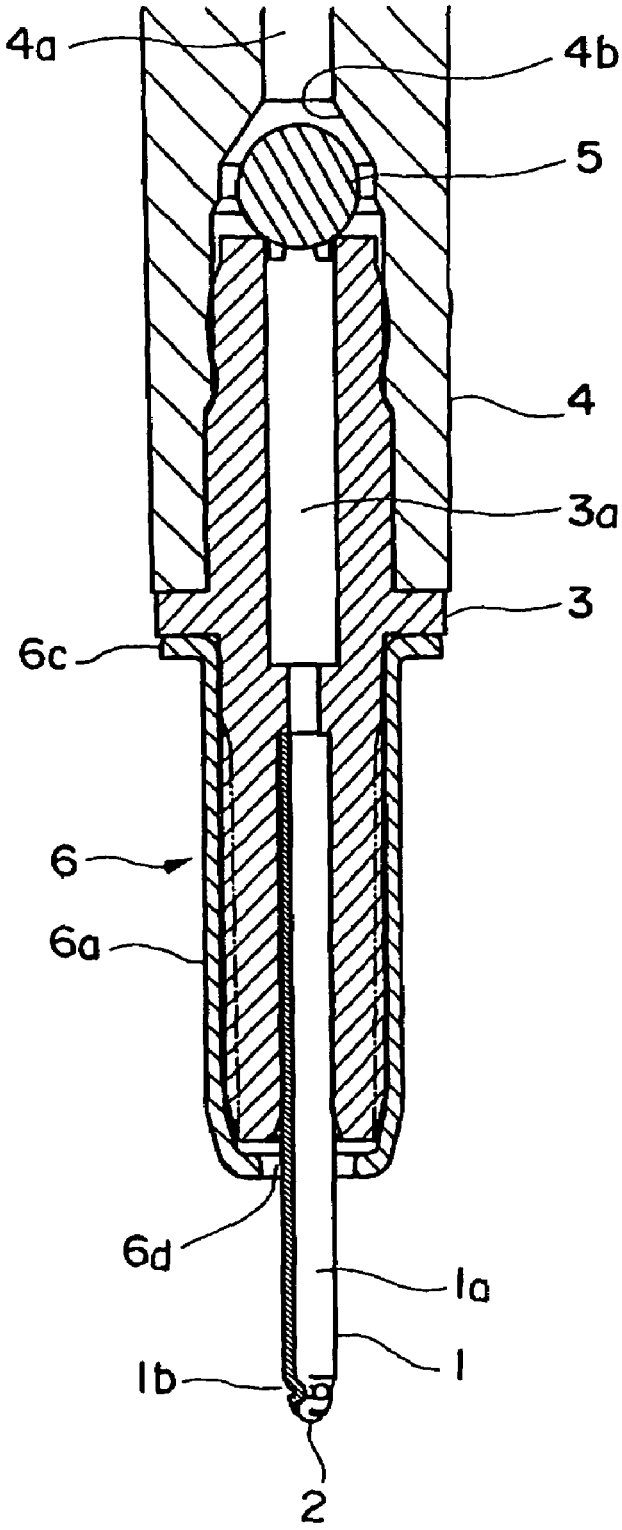

[Fig. 4]
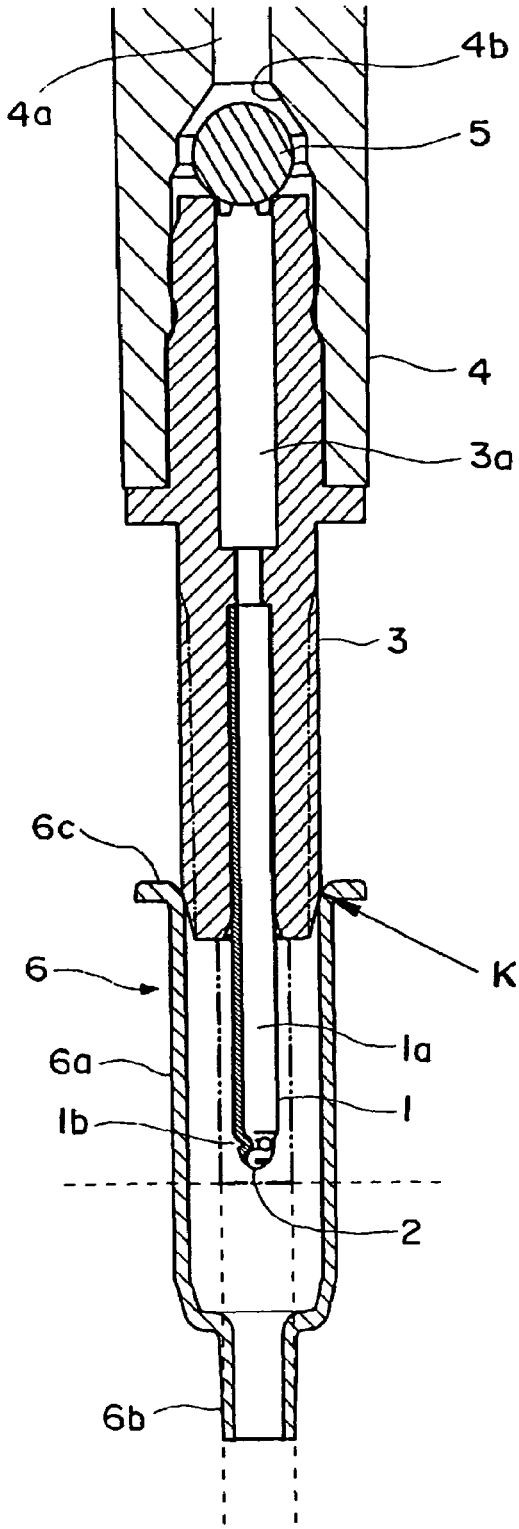

[Fig. 5]
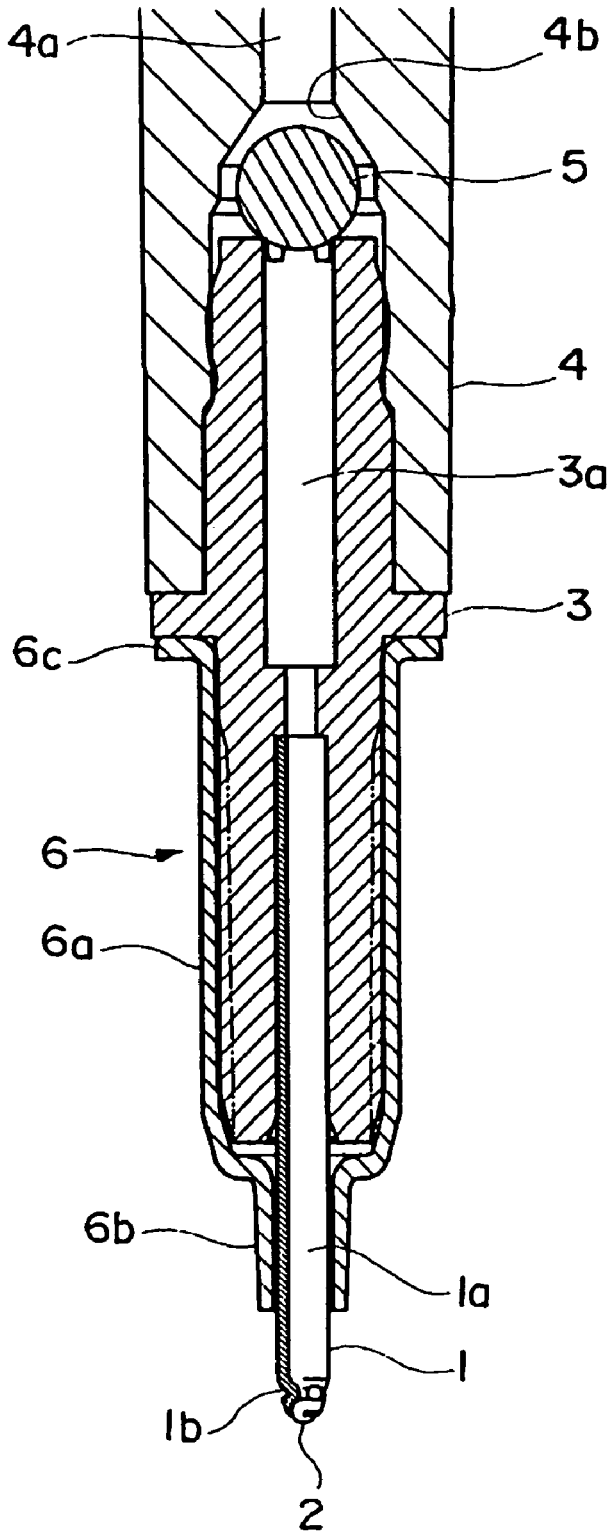

[Fig. 6]
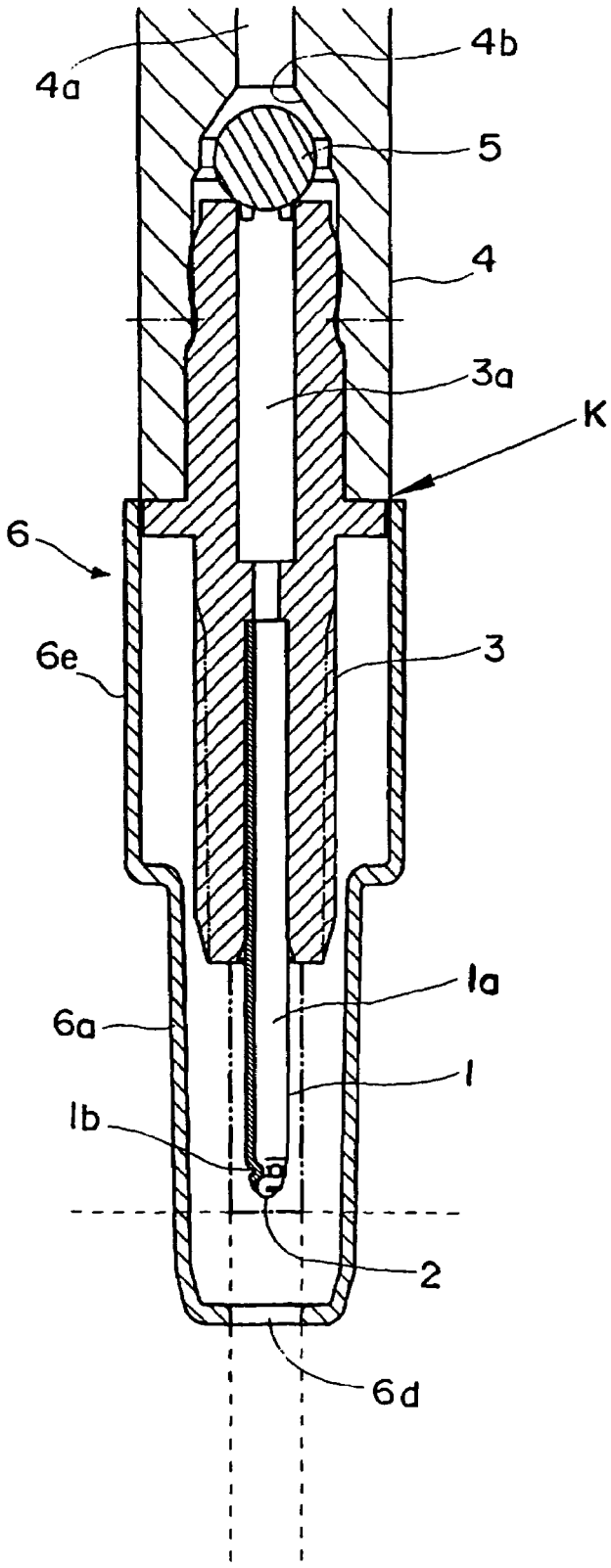

[Fig. 7]
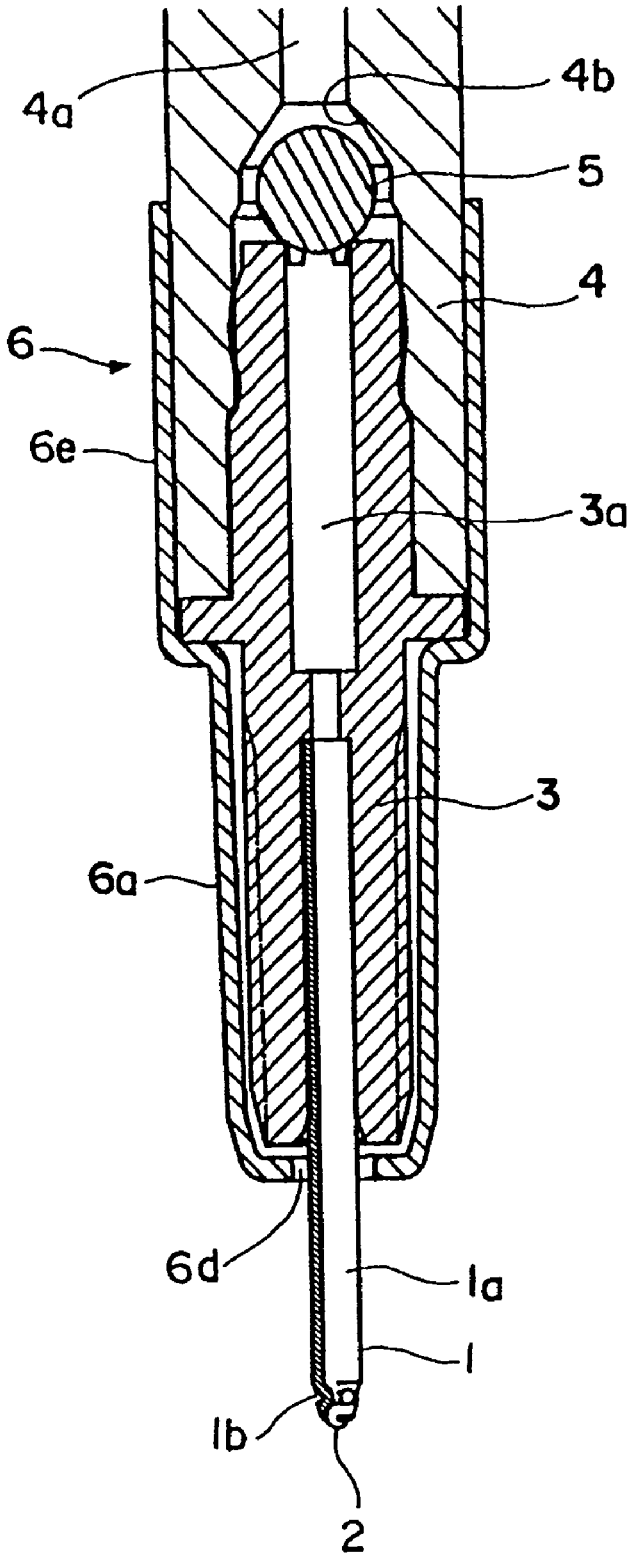

[Fig. 8]
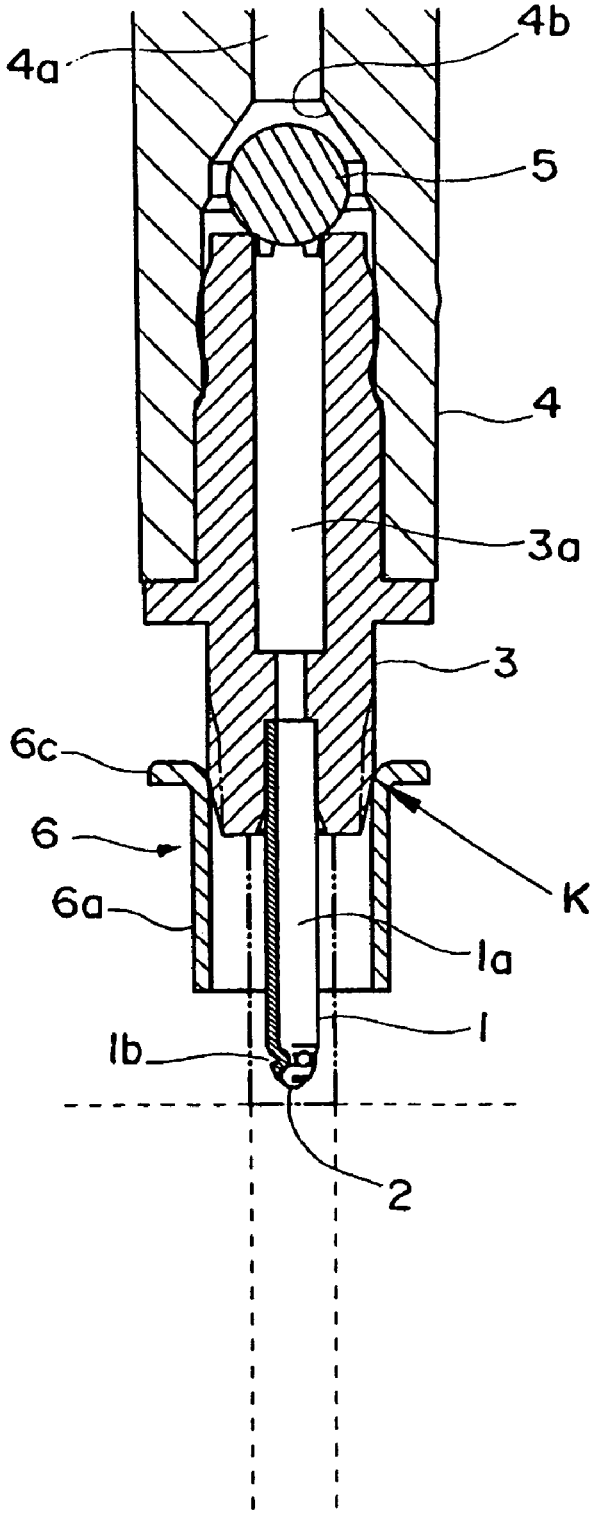

[Fig. 9]
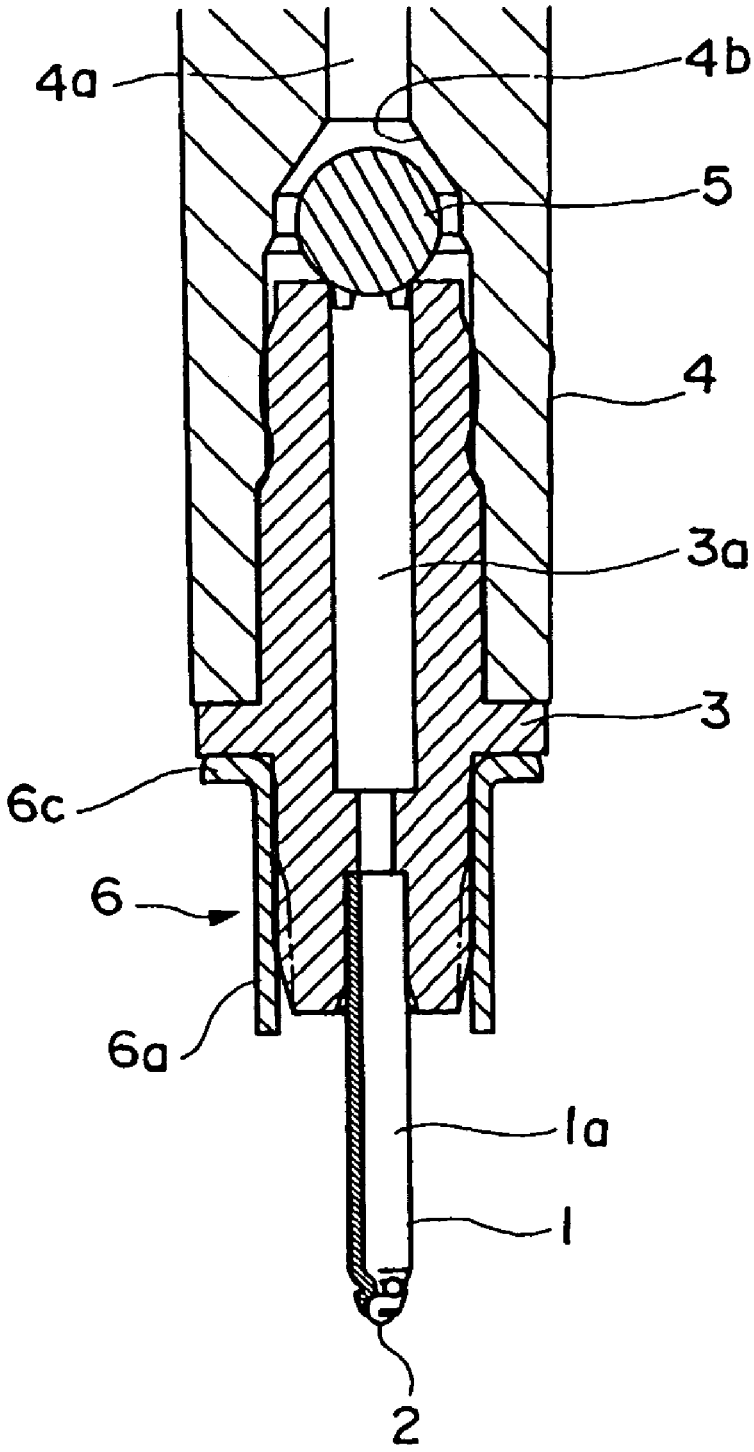

[Fig. 10]
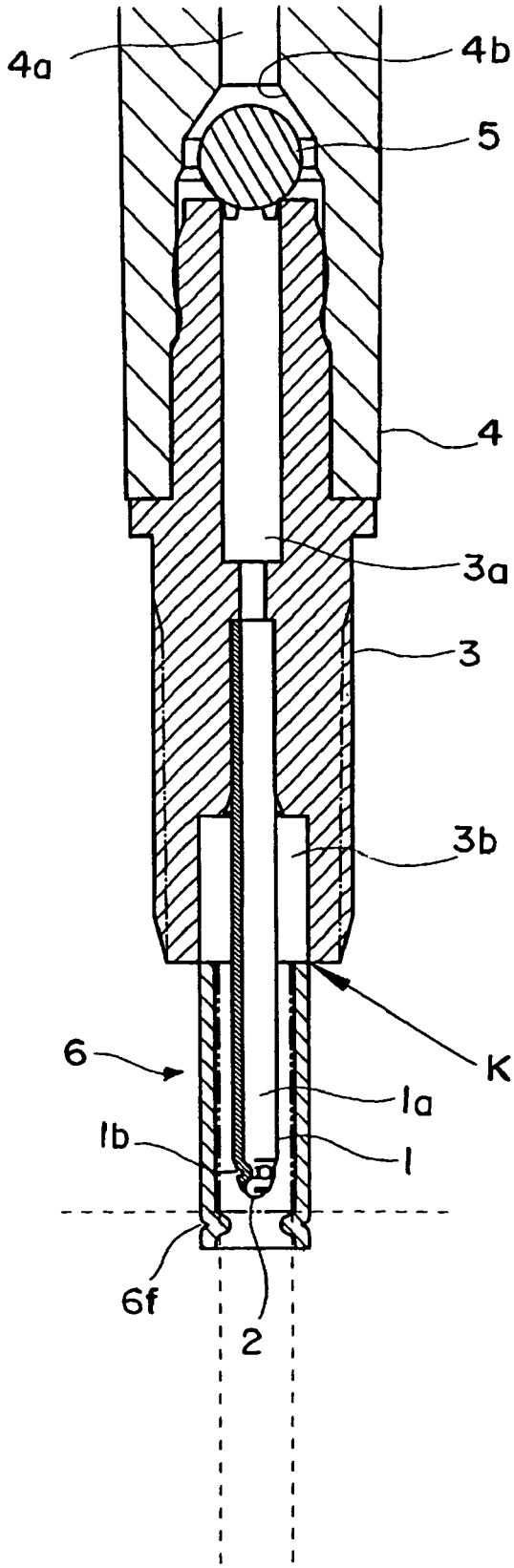

[Fig. 11]
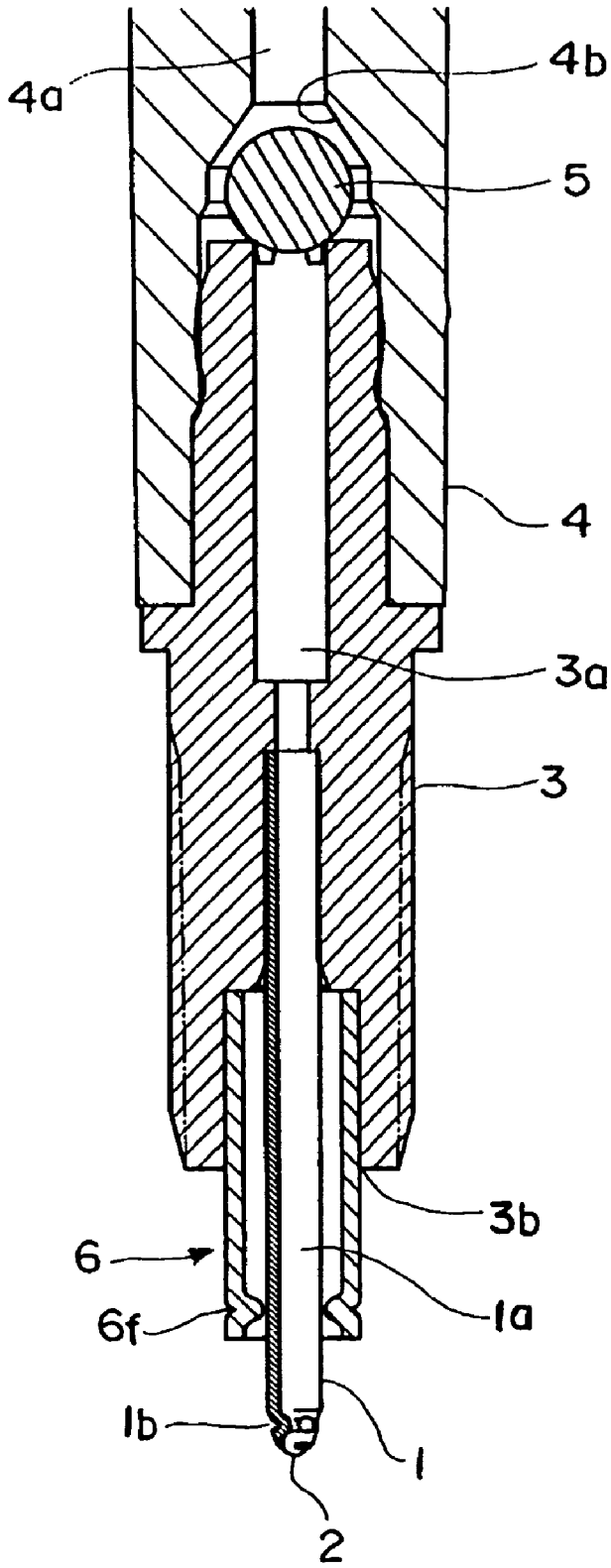

[Fig. 12]
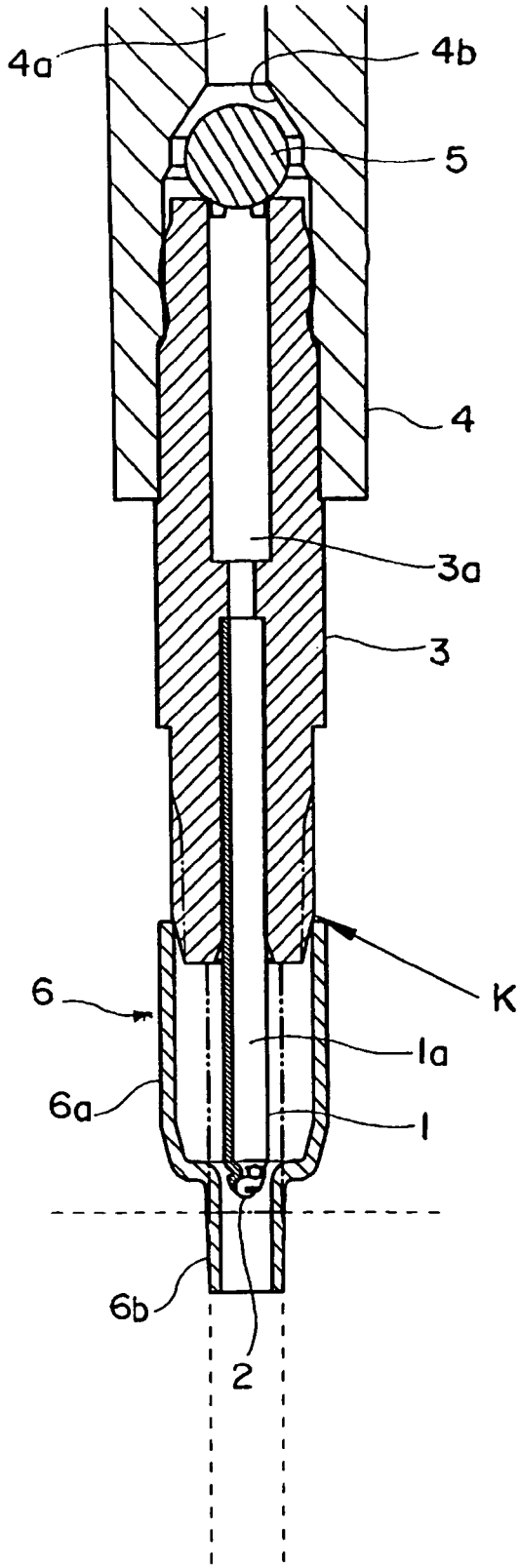

[Fig. 13]
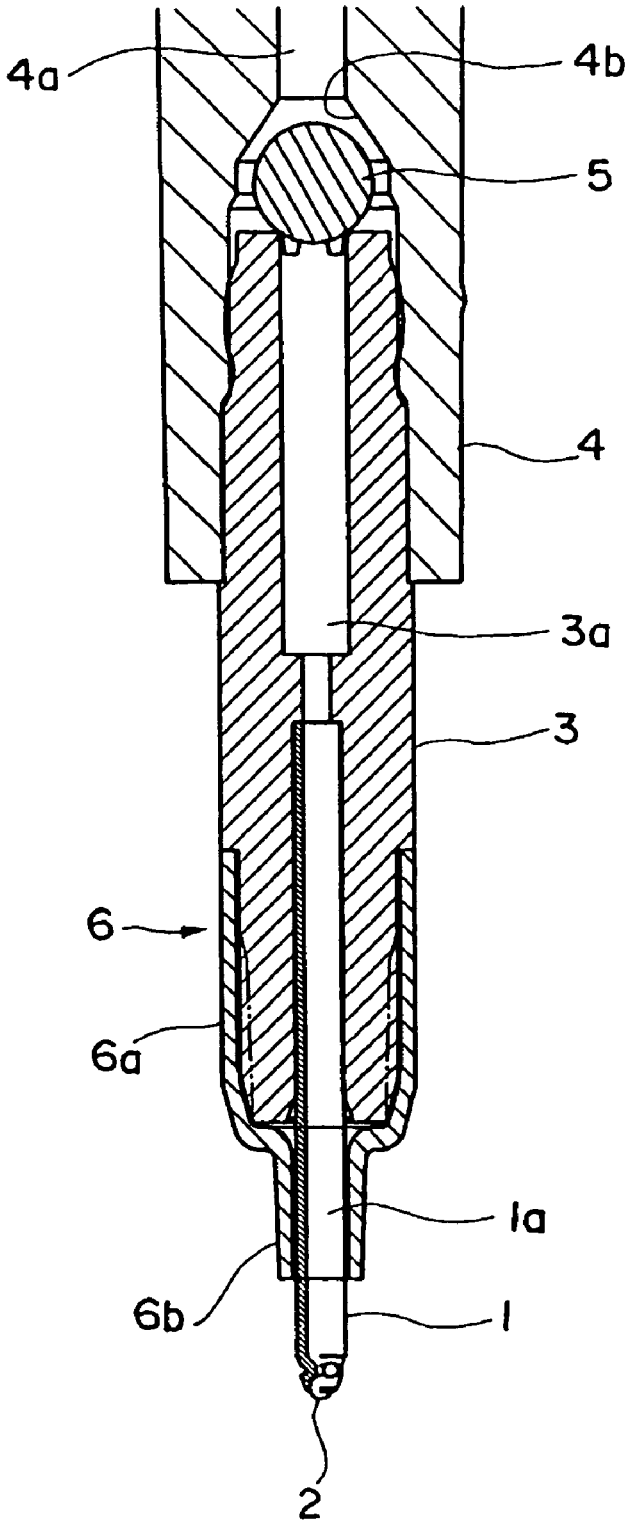

BALL-POINT PEN

TECHNICAL FIELD

The present invention relates a ball-point pen using a refill provided with a writing tip at a top end of which a writing ball is rotatably supported, an ink storage tube inside of which ink is stored, and a joint member for connecting the above-mentioned writing tip and ink storage tube and supplying the ink in the ink storage tube to the above-mentioned writing tip side.

BACKGROUND ART

Conventionally, some ball-point pens especially designed for fine writing are provided in which their writing tips are reduced in diameter. There is a purpose of reducing an area as much as possible in which the writing tip may hide written lines in the case of writing and drawing small and fine letters and figures. The thus diameter-reduced writing tips are accepted in the market, which are made from a pipe-like material by way of plasticity processing or cutting, or formed from a cylindrical material by cutting, for example.

As described above, when the writing tip is reduced in diameter, a problem arises in that its tip end to which writing pressure is applied has poor rigidity, and that as the tip is reduced in diameter, its inner diameter i.e., an ink passage is also reduced in diameter so that an insufficient amount of ink is supplied to the writing ball side at the top end. Thus, there arises a technical condition that axial length of the writing tip must be designed to be as short as possible. Therefore, a joint member into which the writing tip is press-fitted and which is made of a less glittering synthetic resin is extended to the vicinity of the top end of the writing tip, leading to a secondary problem of damaging its appearance.

Each of the following patent documents discloses a ball-point pen structure for compensating for the insufficient rigidity of the writing tip end to which the above-mentioned writing pressure is applied and for preventing the writing tip from being bent and swinging. In other words, Japanese Utility Model Publication (KOKAI) No. H7-37681 discloses a structure in which a metal cover member is employed to compensate for the poor rigidity of the writing tip. Japanese Patent Publication (KOKAI) No. H8-118876 discloses a structure in which a part of a metal cover member for compensating for lack of rigidity of a writing tip is further supported in abutment with a writing tip. Further, Japanese Patent Publication (KOKAI) No. H8-118877 discloses a structure in which a metal cover member for compensating for lack of rigidity of a writing tip is press-fitted to a perimeter of the writing tip.

FIGS. 12 and 13 show a structure of a metal cover member adopted for a ball-point pen as disclosed in the above-mentioned Japanese Utility Model Publication (KOKAI) No. H7-37681. In addition, FIG. 12 shows, in section, a situation where the cover member is about to be fitted onto a joint member along its perimeter surface. FIG. 13 shows, in section, a situation where the cover member is mounted on the perimeter surface of the joint member. In these FIGS. 12 and 13, reference numeral 1 indicates a writing tip at the top end of which a writing ball 2 is rotatably supported, reference numeral 3 shows a first joint member made of a synthetic resin onto which the above-mentioned writing tip 1 is press-fitted, and reference numeral 4 shows a second joint member similarly made of a synthetic resin into which the above-mentioned first joint member 3 is press-fitted further.

In addition, although not shown in these FIGS. 12 and 13, the above-mentioned second joint member 4 is further press-fitted into an ink storage tube as will be described later, to constitute a ball-point pen refill. It is arranged that ink passages 1*a*, 3*a* and 4*a* are respectively formed at the above-mentioned writing tip 1, first joint member 3, and second joint member 4 such that ink from the above-mentioned ink storage tube may be supplied toward the writing ball 2 disposed at the top end of the writing tip 1.

Further, a valve room 4*b* is formed in the above-mentioned second joint member 4 so as to be formed conical toward the ink passage 4*a*, and a ball valve 5 is accommodated in the valve room 4*b*. With this structure, for example, when writing upwards, the ball valve 5 achieves valve closing operation at the above-mentioned conical section of the valve room 4*b*, prevents the ink from flowing backwards, and acts to be able to prevent air from flowing into the writing tip 1.

It is arranged that a metal cylindrical cover member 6 may be mounted by fitting it on the first joint member 3 in the ball-point pen refill having the structure as described above along the perimeter surface of this joint member 3. As shown, this cover member 6 is constituted by a large diameter portion 6*a* and a small diameter portion 6*b* which are integral with each other. It is arranged that the large diameter portion 6*a* is fitted along the perimeter surface of the joint member 3 so that the small diameter portion 6*b* can surround first joint member 3 side of the writing tip 1.

Thus, according to the situation as shown in FIG. 13 where the cover member 6 is mounted and fitted along the perimeter surface of the joint member 3, the perimeter surface of the writing tip 1 is surrounded by the small diameter portion 6*b* of the cover member 6. Therefore, when the writing tip 1 is subjected to writing pressure to be about to bend and swing, the small diameter portion 6*b* of the cover member 6 is brought into contact with the writing tip 1 and acts to prevent this operation.

Patent document 1: Japanese Utility Model Publication (KOKAI) No. H7-37681

Patent document 2: Japanese Patent Publication (KOKAI) No. H8-118876

Patent document 3: Japanese Patent Publication (KOKAI) No. H8-118877

DISCLOSURE OF THE INVENTION

Problems to be Solved by the Invention

Now, according to the structure of the above-mentioned cover member 6 as disclosed in Japanese Utility Model Publication (KOKAI) No. H7-37681, when trying to fit the large diameter portion 6*a* of the cover member 6 along the perimeter surface of the first joint member 3 as shown in FIG. 12, in other words, in a situation where the cover member 6 is in contact with the perimeter surface of the first joint member 3 as indicated by arrow K, the inside of the small diameter portion 6*b* in the cover member 6 approaches the vicinity of the top end portion of the writing tip 1 considerably. Furthermore, when various types of variations as will be described later take place at this stage, a problem arises in that the cover member 6 may damage the vicinity of the top end portion of the writing tip 1. In particular, as described above, when the writing tip reduced in diameter for extra fine writing is employed, it may not only damage the tip end portion but also cause a fatal damage.

Although this problem may also be solved by means of a jig used at the time of manual assembly and by way of improvement in accuracy of an assembly machine, it is necessary to take into consideration economical efficiencies, such as assembly costs and equipment expenses, and it is difficult to solve the problem with improvement in accuracy and the problem with economical efficiencies at the same time. In the case of the above-mentioned assembly, in order to fit the cover member to the above-mentioned joint member without bringing the cover member into contact with the writing tip, a problem arises in positioning accuracy of the writing tip, the joint member, etc., positioning accuracy on the cover member side, and the accuracy of operation of relatively moving and fitting it.

However, although dimension variations of the members to be assembled depend on the members, components made of a synthetic resin have variations of approximately 0.05 mm and even metal components have those of approximately 0.03 mm. In addition, naturally, an equipment side for assembling also has processing variations and positioning accuracy variations, so that clearance etc. for preventing the member from being damaged is required when the member is relatively moved. Therefore, in order to inhibit the cover member from contact with the writing tip, it is necessary to allow accumulation of these variations, which is usually required to be approximately 0.1 mm and preferably about 0.2 mm.

Therefore, especially in the structure of the cover member 6 as shown in FIG. 12, since a part of the cover member 6 (a part of the small diameter portion 6*b* of the cover member in FIG. 12) exists in an allowable range of variations at the time of assembly, i.e., a tolerance range of the above-mentioned variations as indicated by dash double-dotted lines around the writing tip, a problem arises in that the above-mentioned part of the cover member 6 may come into contact with the vicinity of the top end portion of the writing tip 1 and occasionally damage it.

Based on the above-mentioned technical point of view, the present invention has been made aiming to provide a structure of a ball-point pen in which a cover member does not damage a writing tip during an assembly step of fitting and mounting the above-mentioned cover member to the joint member etc.

MEANS TO SOLVE THE PROBLEMS

The ball-point pen in accordance with the present invention made in order to solve the above-mentioned problems is a ball-point pen having a writing tip at a top end of which a writing ball is rotatably supported, an ink storage tube inside of which ink is stored, and a joint member for connecting the above-mentioned writing tip and the above-mentioned ink storage tube and supplying the ink in the ink storage tube to the above-mentioned writing tip side, characterized in that a cover member is further provided which can be fitted and mounted along a perimeter surface of the above-mentioned joint member or along the inside of a mounting hole formed in the above-mentioned joint member, and the above-mentioned cover member is arranged in dimensions so as not to approach within 0.2 mm of the above-mentioned writing tip when an end of the cover member is positioned so as to be in contact with the perimeter surface of the joint member and an axis of the cover member and an axis of the joint member are aligned, or when an end of said cover member is positioned so as to be in contact with an inner periphery of the mounting hole and an axis of the cover member and an axis of the joint member are aligned.

According to this ball-point pen, it is arranged in dimensions that when the cover member is fitted along the perimeter surface of the joint member or along the inside of the mounting hole, the cover member does not approach within 0.2 mm of the writing tip. Thus, even if there are individual molding variations of the cover member, the writing tip, the joint member, etc. as described above and the above-mentioned various types of variations in the assembly machine and the jig, it is possible to finish a product without damaging the writing tip when the above-mentioned cover member is fitted.

In this case, it is desirable that the above-mentioned cover member is constituted by a metal material. Thus, by constructing the cover member with the metal material, sufficient reinforcement effects may be provided for the joint member to which the writing tip is press-fitted. Further, metallic luster of the cover member provides an effect of raising appearance quality and bringing out a high-class feeling. Further, it is expected that the metal cover member can provide an effect of effectively inhibiting an ink solvent from evaporating through the joint member and inhibiting air from entering the inside on the other hand.

In addition, it is desirable that the above-mentioned writing tip is formed of a pipe-like tip. Thus, the above-mentioned writing tip is preferably formed of the pipe-like tip. In this case, the pipe-like tip used for the material of the above-mentioned writing tip can be formed by way of the plasticity processing of a pipe-like material, and can also be formed of a solid material by cutting. In this case, more preferably, it is desirable that the writing tip is arranged to have a small diameter portion of a length of 1.5 mm or more, in which the front or the whole of the tip has an outer diameter $\phi$ of 1.3 mm or less.

Further, desirably it is arranged in dimensions that the above-mentioned cover member does not approach within 0.2 mm of the writing tip in a relative movement range of the cover member after starting to fit the above-mentioned cover member along the perimeter surface of the above-mentioned joint member or along the inside of the mounting hole until completion of the mounting.

EFFECTS OF THE INVENTION

Thus, since it is arranged in dimensions that the above-mentioned cover member does not approach within 0.2 mm of the writing tip in the relative movement range of the cover member after starting to fit the cover member to the joint member until completion of the mounting, it is possible to further reduce a degree of damage to the writing tip by means of the above-mentioned cover member.

Further, desirably it is arranged that the above-mentioned cover member is formed into a cylindrical shape, a flange bent outwards is formed at one end of the above-mentioned cylindrical portion, so that the above-mentioned flange may come into contact with an end face of the joint member. Thus, since the flange of the cover member is in contact with the end face of the joint member, it is possible to inhibit the joint member from deforming.

BRIEF DESCRIPTION OF THE DRAWINGS

FIG. 1 is a sectional view showing the whole structure of a refill used for a ball-point pen in accordance with the present invention.

FIG. 2 is a sectional view showing a situation where a cover member is about to be fitted, in a first preferred embodiment in accordance with the present invention.

FIG. 3 is a sectional view showing a situation where the cover member is mounted, in the first preferred embodiment in accordance with the present invention.

FIG. 4 is a sectional view showing a situation where the cover member is about to be fitted, in a second preferred embodiment in accordance with the present invention.

FIG. 5 is a sectional view showing a situation where the cover member is mounted, in the second preferred embodiment in accordance with the present invention.

FIG. 6 is a sectional view showing a situation where the cover member is about to be fitted, in a third preferred embodiment in accordance with the present invention.

FIG. 7 is a sectional view showing a situation where the cover member is mounted, in the third preferred embodiment in accordance with the present invention.

FIG. 8 is a sectional view showing a situation where the cover member is about to be fitted, in a fourth preferred embodiment in accordance with the present invention.

FIG. 9 is a sectional view showing a situation where the cover member is mounted, in the fourth preferred embodiment in accordance with the present invention.

FIG. 10 is a sectional view showing a situation where the cover member is about to be fitted, in a fifth preferred embodiment in accordance with the present invention.

FIG. 11 is a sectional view showing a situation where the cover member is mounted in the fifth preferred embodiment in accordance with the present invention.

FIG. 12 is a sectional view of a situation where the cover member is about to be fitted, in a conventional ball-point pen structure.

FIG. 13 is similarly a sectional view of a situation where the cover member is mounted.

BEST MODE FOR CARRYING OUT THE INVENTION

Hereafter, a ball-point pen in accordance with the present invention will be described with reference to preferred embodiments as shown in the drawings. Firstly, FIG. 1 shows the whole structure of a refill which constitutes the ball-point pen in accordance with the present invention. In other words, the ball-point pen is formed by accommodating this refill as shown in FIG. 1 in a well-known body cylinder (not shown). In addition, in the structure of the refill as shown in FIG. 1 and each drawing to be explained hereafter, like parts equivalent to those shown in FIGS. 12 and 13 as already explained are denoted with like reference signs. Accordingly, the description of these will not be repeated.

Firstly, in the structure of the refill as shown in FIG. 1, reference signs 1, 3, 4, 5, and 6 respectively indicate, as already described, a writing tip, a first joint member, a second joint member, a ball valve, and a cover member. It is arranged that a rear end portion of the second joint member 4 is press-fitted in an ink storage tube 7 whereby each joint member including the writing tip 1 etc. is mechanically connected to the ink storage tube 7. Further, the ink storage tube 7 is filled with ink 8 and a grease-like follower 9 is disposed at a rear end of the ink, and moves inside the ink storage tube 7 as the ink reduces.

FIGS. 2 and 3 show a first preferred embodiment in accordance with the present invention, by illustrating and expanding a top end portion side from the second joint member 4 in the refill as shown in FIG. 1. The writing tip 1 in the preferred embodiments as shown in these FIGS. 2 and 3 is formed of a pipe-like tip. This pipe-like tip is formed of a metal pipe material by way of plasticity processing. In other words, it is arranged such that a portion 1*b* projecting inward from a periphery side is formed near the top end portion of the above-mentioned pipe material, and a writing ball 2 is rotatably supported by crimping the top end portion of the pipe material. In particular, the above-mentioned writing tip 1 designed for fine writing is formed by means of a pipe material having a diameter of 1.3 mm or less.

FIG. 2 shows a situation where the cylindrical cover member 6 is about to be fitted along the perimeter surface of the first joint member 3, and FIG. 3 shows a situation where the cover member 6 is fitted and mounted along the perimeter surface of the first joint member 3. The cover member 6 as shown in these FIGS. 2 and 3 is constituted by a metal material. A series of flanges 6*c* bent outwards of the perimeter are formed at one end of a cylindrical portion 6*a* which is formed cylindrically. Further, the other end is processed to be in a closed situation, and an opening 6*d* of a substantially complete circle is formed at the closed portion.

In order to mount this cover member 6, firstly an end of the cover member 6 in which the flanges 6*c* are formed as shown in FIG. 2 is located to be in contact with the perimeter surface of the first joint member 3. Then, the cover member 6 is pushed along the perimeter surface of the first joint member 3, while maintaining its attitude. As a result, the flanges 6*c* of the cover member 6 come into contact with an end face of the first joint member 3, and the cover member 6 is fitted and mounted on the perimeter surface of the first joint member 3 as shown in FIG. 3.

Here, as shown in FIG. 2, the end of the cover member 6 is positioned so as to be in contact with the perimeter surface of the first joint member 3 as indicated by arrow K, and when an axis of the cover member 6 and an axis of the joint member 3 are aligned, the above-mentioned cover member 6 is arranged in dimensions so as not to approach within a predetermined range around the above-mentioned writing tip 1 as shown by dash double-dotted lines.

The predetermined range as indicated by the dash double-dotted lines around the above-mentioned writing tip 1 is set as 0.2 mm in this preferred embodiment. As already described, this is the maximum range of allowable variations at the time of assembly. Therefore, according to the structure of the cover member 6 as shown in this FIG. 2, it is possible to avoid the problem that a part of the cover member 6 comes into contact with the writing tip 1 and damages the writing tip 1 when the cover member 6 is about to be fitted to the perimeter surface of the first joint member 3.

Further, when the cover member 6 is somewhat pushed along the perimeter surface of the first joint member 3, the perimeter surface of the first joint member 3 serves as a guide, and the cover member 6 is pushed accordingly along the perimeter surface of the first joint member 3. In this preferred embodiment, it is arranged that the diameter of the opening 6*d* formed at the cover member 6 as shown in FIG. 2 is an inner diameter greater than the range of the above-mentioned dash double-dotted lines.

In other words, it is arranged in dimensions that the cover member does not approach within 0.2 mm of the writing tip 1 in the relative movement range of the cover member after starting to fit the cover member 6 along the perimeter surface of the joint member 3 until completion of the mounting. Therefore, according to this structure, it is possible to avoid the problem that a part of the opening 6*d* comes into contact with and damages the writing tip 1 when the cover member 6 is mounted.

In the first preferred embodiment as described above and as shown in FIGS. 2 and 3, the cover member 6 is not provided with a function of compensating for lack of rigidity of the writing tip 1. However, in a situation where the cover member 6 is mounted, the first joint member 3 is surrounded by the metal cover member 6, and acts so that the first joint member 3 into which the writing tip 1 is press-fitted and fixed may be reinforced. In addition, since the flange 6*c* of the cover member 6 comes into contact with the end face of the first joint member 3, the first joint member 3 is inhibited from deforming.

In this case, when a metal material is used for the cover member 6, its luster provides an effect of raising appearance quality and bringing out a high-class feeling. Further, it is expected that the above-mentioned metal cover member 6 can provide an effect of effectively inhibiting an ink solvent from evaporating through the joint member 3 and inhibiting air from entering the inside on the other hand.

In addition, since a plurality of ribs are formed on the perimeter surface of the first joint member 3 in an axial direction (see dash double-dotted lines shown in FIG. 3) and the opening 6*d* is provided at the cover member 6, the perimeter surface of the first joint member is in contact with open air through the opening 6*d*. Therefore, volatilization of the ink solvent and ingress of air are controlled near a base (near the flanges 6*c*) of the cover member 6. If the opening 6*d* is closed or the cover member 6 and the perimeter surface of the first joint member 3 are brought into close contact with each other, the volatilization of the ink solvent and the ingress of air can be controlled further.

FIGS. 4 and 5 show a second preferred embodiment in accordance with the present invention, and a top end portion side of the second joint member 4 is expanded and shown similarly. FIG. 4 shows a situation where the cylindrical cover member 6 is about to be fitted along the perimeter surface of the first joint member 3, and FIG. 5 shows a situation where the cover member 6 is fitted and mounted along the perimeter surface of the first joint member 3.

In the preferred embodiment as shown in these FIGS. 4 and 5, the small diameter portion 6*b* which surrounds a part of the writing tip 1 is provided for the cover member 6 constituted by the metal material, to have the function of compensating for the lack of rigidity of the writing tip 1. In other words, the cover member 6 as shown in FIGS. 4 and 5 is provided with the small diameter portion 6*b* as with the structure shown in FIGS. 12 and 13 as already described. When the writing tip 1 is subjected to writing pressure to be about to bend and swing, the small diameter portion 6*b* is brought into contact with the writing tip 1 and acts to prevent this operation.

On the other hand, the cover member 6 in accordance with this preferred embodiment is positioned so that an end of the cover member 6 may be brought into contact with the perimeter surface of the first joint member 3 as shown in FIG. 4 and as indicated by arrow K, and when the axis of the cover member 6 and the axis of the joint member 3 are aligned, the above-mentioned cover member 6 is arranged in dimensions so as not to approach within the predetermined range (0.2 mm) around the above-mentioned writing tip 1 as shown by dash double-dotted lines. Therefore, according to the structure of the cover member 6 as shown in this FIG. 4, it is possible to avoid the problem that the part of the cover member 6 comes into contact with the writing tip 1 and damages the writing tip 1 when the cover member 6 is about to be fitted to the perimeter surface of the first joint member 3.

Further, when the cover member 6 is somewhat pushed along the perimeter surface of the first joint member 3, the perimeter surface of the first joint member 3 serves as the guide, and the cover member 6 is pushed accordingly along the perimeter surface of the first joint member 3. Therefore, by setting some clearance between an outer diameter of the writing tip 1 and an inner diameter of the small diameter portion 6*b* in the cover member 6, it is possible to avoid the problem that the writing tip 1 is damaged by the cover member 6 in an assembly process.

Also in the structure as shown in these FIGS. 4 and 5, it is possible to obtain an operational effect similar to that of the preferred embodiment as already described and as shown in FIGS. 2 and 3, and the small diameter portion 6*b* formed in the cover member 6 can compensate for the lack of rigidity of the writing tip, and effectively prevent the writing tip from bending and swinging due to the writing pressure.

FIGS. 6 and 7 show a third preferred embodiment in accordance with the present invention, and the top end portion side of the second joint member 4 is expanded and shown similarly. FIG. 6 shows a situation where the cylindrical cover member 6 is about to be fitted along a perimeter surface of the second joint member 4, and FIG. 7 shows a situation where the cover member 6 is fitted and mounted along the perimeter surface of the second joint member 4.

In the preferred embodiment as shown in these FIGS. 6 and 7, a large diameter portion 6*e* to be fitted to the perimeter surface of the second joint member 4 is formed at the cylindrical cover member 6 constituted by a metal material. Other structural components, except for this large diameter portion 6*e*, of the cover member are similar to those shown in FIGS. 2 and 3 as already described.

The cover member 6 as shown in FIGS. 6 and 7 is positioned so that an end of the cover member may be brought into contact with the perimeter surface of the second joint member 4 as shown in FIG. 6 and as indicated by arrow K, and when the axis of the cover member 6 and the axis of the joint member 4 are aligned, the above-mentioned cover member 6 is arranged in dimensions so as not to approach within the predetermined range (0.2 mm) around the above-mentioned writing tip 1 as shown by dash double-dotted lines. Therefore, according to the structure of the cover member 6 as shown in this FIG. 7, the cover member 6 does not come into contact with the writing tip 1 when the cover member 6 is about to be fitted to the perimeter surface of the second joint member 4, thus avoiding the problem of damaging the writing tip 1.

Further, when the cover member 6 is somewhat pushed along the perimeter surface of the second joint member 4, the perimeter surface of the second joint member 4 serves as the guide, and the cover member 6 is pushed accordingly along the perimeter surface of the second joint member 4. In this preferred embodiment, it is arranged that the diameter of the opening 6*d* formed at the cover member 6 as shown in FIG. 6 is an inner diameter greater than the range of the above-mentioned dash double-dotted lines.

In other words, it is arranged in dimensions that the cover member does not approach within 0.2 mm of the writing tip 1 in the relative movement range of the cover member after starting to fit the cover member 6 along the perimeter surface of the joint member 4 until completion of the mounting. Therefore, according to this structure, it is possible to effectively avoid the problem that the part of the opening 6*d* comes into contact with and damages the writing tip 1 when the cover member 6 is mounted.

In the third preferred embodiment as described above and as shown in FIGS. 6 and 7, the cover member 6 is not provided with the function of compensating for the lack of rigidity of the writing tip 1. However, in a situation where the cover member 6 is mounted, the second joint member 4 is surrounded by the metal cover member 6, and acts so that the second joint member 4 may be reinforced. In this case, when a metal material is used for the cover member 6, its luster provides an effect of raising appearance quality and bringing out a high-class feeling. Further, it is expected that the above-mentioned metal cover member 6 can provide an effect of effectively inhibiting an ink solvent from evaporating through the first joint member 3 and the second joint member 4 and inhibiting air from entering the inside on the other hand.

In addition, since a space is formed between the perimeter surface of the first joint member 3 and an inner periphery of the cover member 6 and since the opening 6*d* is provided for the cover member 6, the perimeter surface of the first joint member 3 is in contact with open air through the opening 6*d*. Therefore, volatilization of the ink solvent and ingress of air are controlled near the front (on the writing tip side) of the second joint member 4 covered by the cover member 6. If the opening 6*d* is closed or the cover member 6 and the perimeter surface of the first joint member 3 are brought into close contact with each other, the volatilization of the ink solvent and the ingress of air can be controlled further.

FIGS. 8 and 9 show a fourth preferred embodiment in accordance with the present invention, and a top end portion side of the second joint member 4 is expanded and shown similarly. FIG. 8 shows a situation where the cylindrical cover member 6 is about to be fitted along the perimeter surface of the first joint member 3, and FIG. 9 shows a situation where the cover member 6 is fitted and mounted along the perimeter surface of the first joint member 3.

The cover member 6 as shown in FIGS. 8 and 9 is constituted by a cylindrical portion 6*a* and flanges 6*c* and it is arranged that the cylindrical portion 6*a* is fitted to the perimeter surface of the first joint member 3. In this case, as shown in FIG. 8, the end of the cover member 6 is positioned so as to be in contact with the perimeter surface of the second joint member 4 as indicated by arrow K, and when the axis of the cover member 6 and the axis of the joint member 3 are aligned, the above-mentioned cover member 6 is arranged in dimensions so as not to approach within the predetermined range (0.2 mm) around the above-mentioned writing tip 1 as shown by dash double-dotted lines.

Therefore, according to the structure of the cover member 6 as shown in this FIG. 8, it is possible to avoid the problem that the part of the cover member 6 comes into contact with the writing tip 1 and damages the writing tip 1, when the cover member 6 is about to be fitted to the perimeter surface of the first joint member 4.

Further, when the cover member 6 is somewhat pushed along the perimeter surface of the first joint member 3, the perimeter surface of the first joint member 3 serves as the guide, and the cover member 6 is pushed accordingly along the perimeter surface of the first joint member 3.

In the fourth preferred embodiment as described above and as shown in FIGS. 8 and 9, the cover member 6 is not provided with the function of compensating for the lack of rigidity of the writing tip 1. However, in the situation where the cover member 6 is mounted, the first joint member 3 is surrounded by the metal cover member 6, and acts so that the first joint member 3 into which the writing tip 1 is press-fitted and fixed may be reinforced. In addition, since the flange 6*c* of the cover member 6 comes into contact with the end face of the first joint member 3, the first joint member 3 is inhibited from deforming. The metallic luster of the cover member 6 provides an effect of raising appearance quality and bringing out a high-class feeling.

FIGS. 10 and 11 show a fifth preferred embodiment in accordance with the present invention, the top end portion side of the second joint member 4 is expanded and shown similarly. FIG. 10 shows a situation where the cover member 6 is about to be fitted along the inside of a mounting hole formed at the first joint member 3, and FIG. 11 shows a situation where the cover member 6 is fitted and mounted along the inside of a mounting hole of the first joint member 3.

In this preferred embodiment, a mounting hole 3*b* into which the cover member 6 is fitted as described above is formed at the first joint member 3. This mounting hole 3*b* is formed along a circumference of the press-fitted writing tip 1, and it is constructed so that the perimeter surface of the cover member 6 may be fitted to an inner periphery of this mounting hole 3*b*. Therefore, the cover member 6 used here forms a perimeter surface of a simple cylindrical face.

In this preferred embodiment, in order for the cover member 6 to have the function of compensating for the lack of rigidity of the writing tip 1, a diameter-reduced portion 6*f* is formed near the top end portion. This diameter-reduced portion 6*f* is such that an annular projection is formed inwardly at the inner periphery of the cover member 6 by drawing the cylindrical cover member 6 constituted by the metal material from its perimeter surface.

In this preferred embodiment, the end of the cover member 6 as shown in FIG. 10 is positioned so as to be in contact with the inner periphery of the mounting hole 3*b* as indicated by arrow K, and when the axis of the cover member 6 and the axis of the joint member 3 are aligned, the above-mentioned cover member 6 is arranged in dimensions so as not to approach within the predetermined range (0.2 mm) around the above-mentioned writing tip 1 as shown by dash double-dotted lines. Therefore, according to the structure of the cover member 6 as shown in this FIG. 10, it is possible to avoid the problem that the part of the cover member 6 comes into contact with the writing tip 1 and damages the writing tip 1, when the cover member 6 is about to be fitted to the mounting hole 3*b* of the first joint member 3.

Further, when the cover member 6 is somewhat pushed in the above-mentioned mounting hole 3*b* of the first joint member 3, the mounting hole 3*b* of the first joint member 3 serves as the guide, and the cover member 6 is pushed accordingly along the above-mentioned mounting hole 3*b*. Although, it is arranged that the inner diameter of the diameter-reduced portion 6*f* formed at the cover member 6 as shown in FIG. 10 is smaller than the predetermined range around the writing tip 1 as indicated by dash double-dotted lines, the diameter-reduced portions 6*f* does not come into contact with the writing tip 1 at this time, since the cover member 6 is guided and mounted by the inner periphery of the above-mentioned mounting hole 3*b* formed at the first joint member 3, thus avoiding the problem that the writing tip 1 is damaged.

According to the fifth preferred embodiment as shown in FIGS. 10 and 11, when the writing tip 1 is subjected to writing pressure to be about to bend and swing, the diameter-reduced portion 6*f* formed at the cover member 6 is brought into contact with the writing tip 1 and acts to prevent this operation. Therefore, according to the fifth preferred embodiment, the diameter-reduced portion 6*f* formed at the cover member 6 achieves the function of compensating for the lack of rigidity of the writing tip 1. In addition, the cover member 6 is designed to surround the base part of the writing tip 1, and the metallic luster of the cover member 6 provides an effect of bringing out a high-class feeling.

Although every cover member 6 in each of the preferred embodiments as described above uses one that is formed into a cylindrical shape, this cover member is not necessarily formed into the cylindrical shape. It may only be arranged to cover a part of the joint member or the writing tip.

The invention claimed is:

1. A ball-point pen having a writing tip at a top end of which a writing ball is rotatably supported, an ink storage tube inside of which ink is stored, and a joint member for connecting said writing tip and said ink storage tube and supplying the ink in the ink storage tube to said writing tip side, characterized in that a cover member is further provided which is fitted and mounted along a perimeter surface of said joint member, and said cover member is arranged in dimensions so as not to approach within 0.2 mm of said writing tip when an end of said cover member is positioned so as to be in contact with the perimeter surface of said joint member and an axis of said cover member and an axis of said joint member are aligned.

2. A ball-point pen having a writing tip at a top end of which a writing ball is rotatably supported, an ink storage tube inside of which ink is stored, and a joint member for connecting said writing tip and said ink storage tube and supplying the ink in the ink storage tube to said writing tip side, characterized in that a cover member is further provided which is fitted and mounted along the inside of a mounting hole formed at said joint member, and said cover member is arranged in dimensions so as not to approach within 0.2 mm of said writing tip when an end of said cover member is positioned so as to be in contact with an inner periphery of the mounting hole and an axis of said cover member and an axis of said joint member are aligned.

3. The ball-point pen as claimed in claim 1 or 2, characterized in that said cover member is constituted by a metal material.

4. The ball-point pen as claimed in claim 1 or 2, characterized in that said writing tip is formed of a pipe-like tip.

5. The ball-point pen as claimed in claim 1, characterized by being arranged in dimensions that said cover member does not approach within 0.2 mm of said writing tip in a relative movement range of the cover member after starting to fit said cover member along the perimeter surface of said joint member until completion of mounting.

6. The ball-point pen as claimed in claim 1, characterized by being arranged that said cover member is formed into a cylindrical shape, a flange bent outward is formed at one end of said cylindrical portion, so that said flange may come into contact with an end face of the joint member.

* * * * *